US007036954B1

(12) United States Patent
Cordle et al.

(10) Patent No.: US 7,036,954 B1
(45) Date of Patent: May 2, 2006

(54) MODULAR CANDLEHOLDER ASSEMBLY

(76) Inventors: D. T. Thomas Cordle, 97 Olde Springs Rd., Columbia, SC (US) 29223; Cynthia J. Cordle, 97 Olde Springs Rd., Columbia, SC (US) 29223

( * ) Notice: Subject to any disclaimer, the term of this patent is extended or adjusted under 35 U.S.C. 154(b) by 103 days.

(21) Appl. No.: 10/694,224

(22) Filed: Oct. 28, 2003

(51) Int. Cl.
*F21L 19/00* (2006.01)

(52) U.S. Cl. ..... 362/161; 362/393; 362/405; 362/249

(58) Field of Classification Search ..... 362/249, 362/227, 122, 123, 234, 810, 393, 405, 161; 439/615; 431/291; D26/13; 428/3, 6
See application file for complete search history.

(56) References Cited

U.S. PATENT DOCUMENTS

| | | | | | |
|---|---|---|---|---|---|
| 2,635,178 | A | * | 4/1953 | Wolter | 431/253 |
| D176,175 | S | | 11/1955 | Ciampa | |
| 3,695,458 | A | * | 10/1972 | Nagel | 211/194 |
| 4,082,872 | A | * | 4/1978 | Hughes | 428/24 |
| 4,262,325 | A | * | 4/1981 | Garcia | 362/121 |
| 4,544,351 | A | | 10/1985 | Marsicano | |
| D303,845 | S | * | 10/1989 | Chappellet | D26/9 |
| 5,577,344 | A | | 11/1996 | Zaremba et al. | |
| 5,630,291 | A | | 5/1997 | Fontana | |
| 5,645,168 | A | | 7/1997 | Honkawa | |
| D407,165 | S | * | 3/1999 | Muto et al. | D26/14 |
| 5,906,868 | A | * | 5/1999 | Akin | 428/3 |
| 6,029,937 | A | | 2/2000 | Funaro | |
| 6,186,646 | B1 | * | 2/2001 | Wiedemer, Jr. | 362/249 |
| 6,229,086 | B1 | * | 5/2001 | Blanding | 174/43 |
| 6,634,513 | B1 | * | 10/2003 | Hardy et al. | 211/194 |

* cited by examiner

*Primary Examiner*—Sandra O'Shea
*Assistant Examiner*—Anabel Ton

(57) ABSTRACT

A modular candleholder assembly includes a first candleholder including an elongated plate having a top side having a plurality of wells extending therein. A rod is attached to a bottom side of the plate and has a free end defining a threaded male coupler. A second candleholder has a generally same shape of the first candleholder and a smaller size than the first candleholder. The second candleholder includes an elongated panel having a top side with a plurality of wells extending therein. A pole is attached to and extends downwardly from a bottom side of the panel. The pole has a free end defining a threaded male coupler. Each of a plurality of bases has a top wall each having a threaded aperture extending therein that is adapted for receiving a threaded male coupler. Each of the bases has a different size. Candles may be selectively positioned in the wells.

14 Claims, 4 Drawing Sheets

MODULAR CANDLEHOLDER ASSEMBLY

BACKGROUND OF THE INVENTION

1. Field of the Invention

The present invention relates to decorative candleholder devices and more particularly pertains to a new decorative candleholder device for providing a plurality of various configurations such that a configuration may be selected for a particular celebration.

2. Description of the Prior Art

The use of decorative candleholder devices is known in the prior art. While these devices fulfill their respective, particular objectives and requirements, the need remains for a modular candleholder so that a plurality of celebrations or events may be provided for by one set of candleholders.

SUMMARY OF THE INVENTION

The present invention meets the needs presented above by the use of a plurality of varying sized and shaped candleholders. At least some of these candleholders include support structures that are couplable directly to bases or to elongated members which space the candleholders from the bases.

Another object of the present invention is to provide a new decorative candleholder device wherein the candleholders include a plurality of openings for the receiving of flower stems to alter the look of the candle holder. The mood of the ceremony may be altered by the addition of flowers and the type of flowers selected.

To this end, the present invention generally comprises a first candleholder including an elongated plate having a top side having a plurality of wells extending therein. A rod is attached to a bottom side of the plate and has a free end defining a threaded mate coupler. A second candleholder has a generally same shape of the first candleholder and a smaller size than the first candleholder. The second candleholder includes an elongated panel having a top side with a plurality of wells extending therein. A pole is attached to and extends downwardly from a bottom side of the panel. The pole has a free end defining a threaded male coupler. Each of a plurality of bases has a bottom wall, a top wall and peripheral wall extending between the top and bottom walls. The top walls each have a threaded aperture extending therein that is adapted for receiving a threaded male coupler. Each of the bases has a different size. Candles may be selectively positioned in the wells.

There has thus been outlined, rather broadly, the more important features of the invention in order that the detailed description thereof that follows nay be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
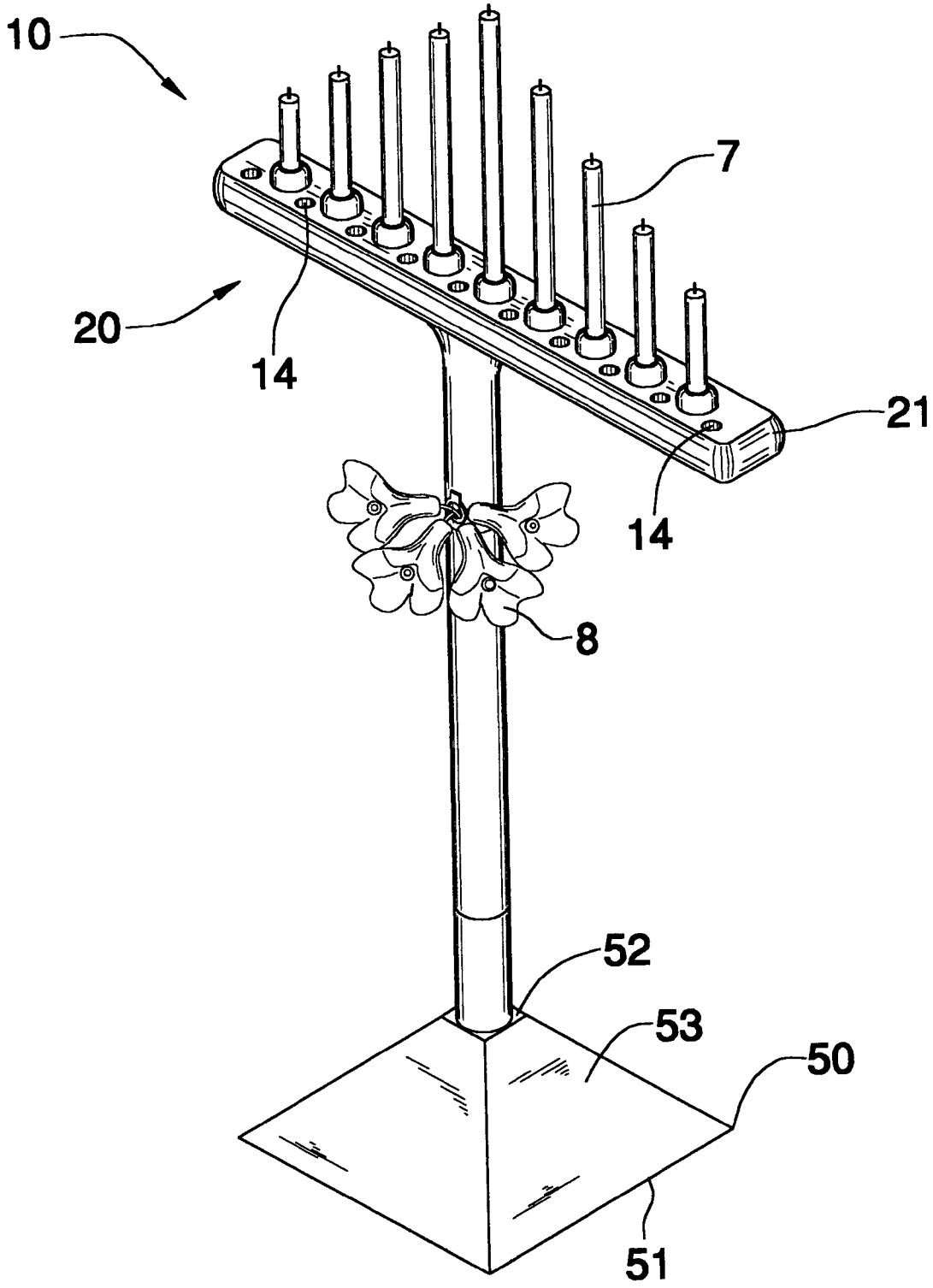
FIG. 1 is a schematic perspective view of a modular candleholder assembly according to the present invention.
Figure 2:
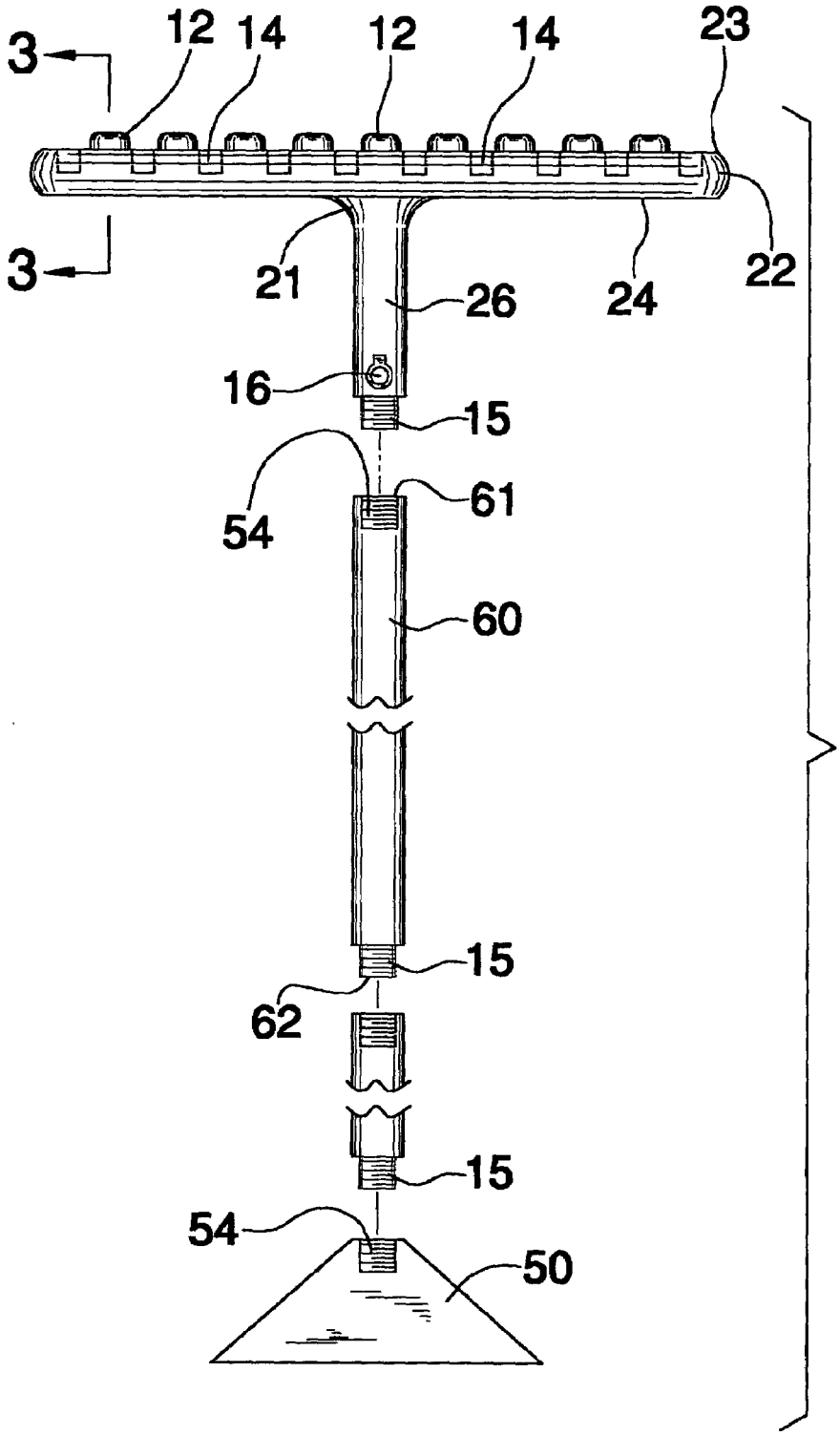
FIG. 2 is a schematic front expanded view of the present invention.
Figure 3:
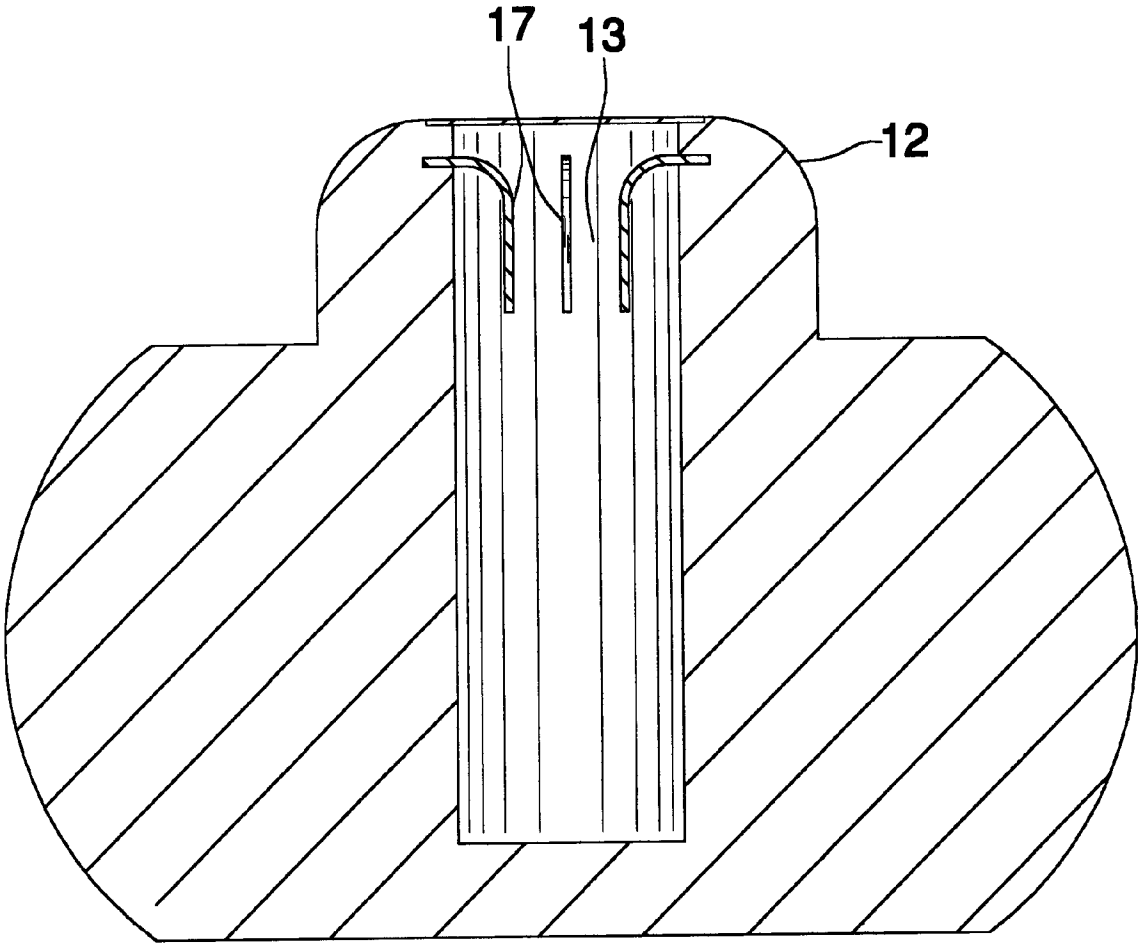
FIG. 3 is a schematic cross-sectional view taken along line 3—3 of FIG. 2 of the present invention.
Figure 4:
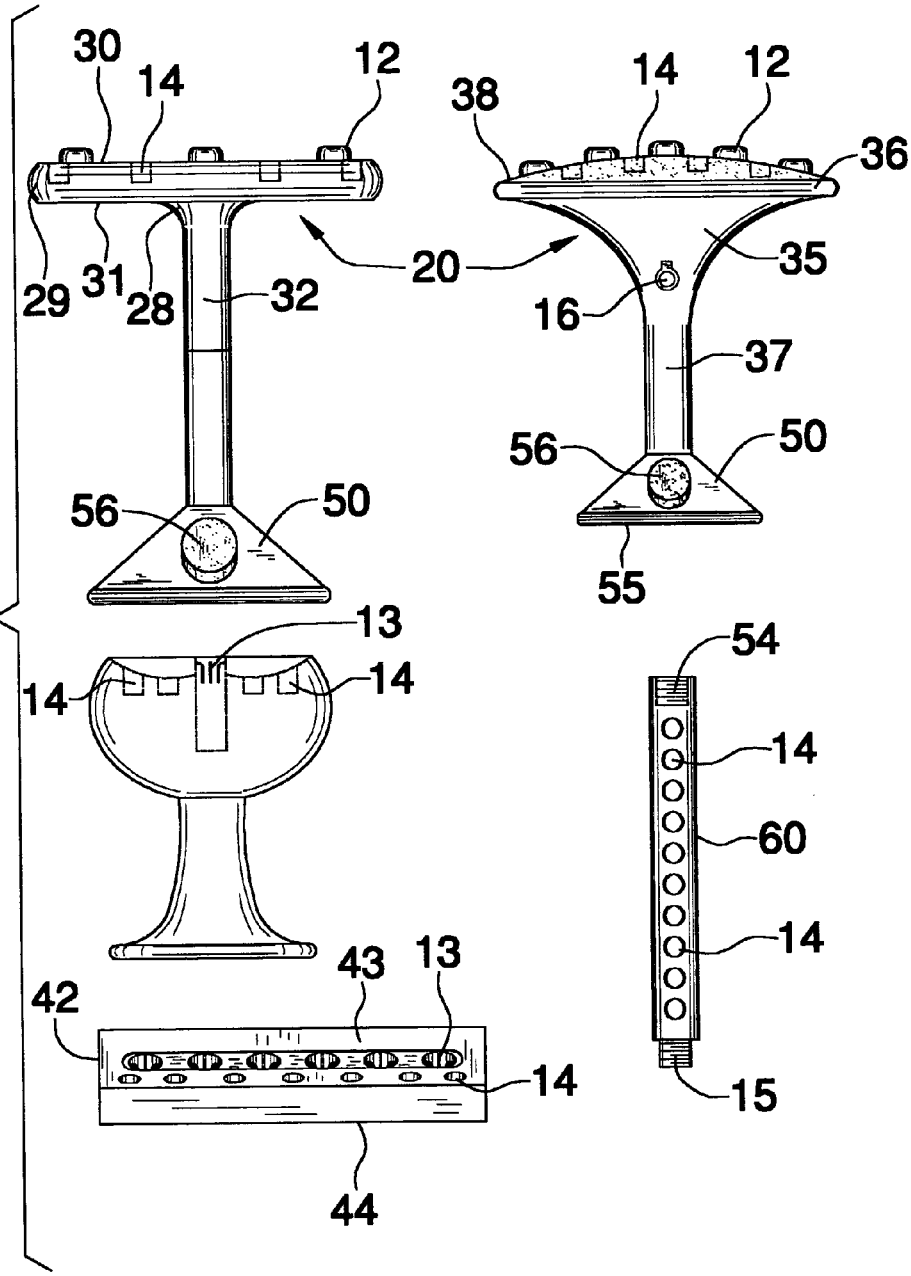
FIG. 4 is a schematic front view of components of the present invention.

With reference now to the drawings, and in particular to FIGS. 1 through 4 thereof, a new decorative candleholder device embodying the principles and concepts of the present invention and generally designated by the reference numeral 10 will be described.

As best illustrated in FIGS. 1 through 4, the modular candleholder assembly 10 generally comprises a plurality of candleholders 20, a plurality of bases 50 and a plurality of extension members 60 for mounting the candleholders 20 at a selected height from the bases.

A first candleholder 21 includes an elongated plate 22 having a top side 23 and a bottom side 24. A plurality of aligned raised portions 12 is integrally attached to the top side 24. Each of the raised portions 12 has a well 13 extending therein. The top side 24 has a plurality of openings 14 extending therein. A rod 26 is attached to and extends downwardly from the bottom side 24. The rod 26 has a free end defining a threaded male coupler 15. The rod 26 has a flower 8 receiving eyelet 16 extending therein.

A second candleholder 28 has generally the same shape of the first candleholder 21 though it has a smaller size than the first candleholder 21. The second candleholder 28 includes an elongated panel 29 having a top side 30 and a bottom side 31. A plurality of aligned raised portions 12 is integrally attached to the top side 30 of the panel 29 and each of the raised portions 12 attached to the panel 29 has a well 13 extending therein. Because of the size difference, there are fewer raised portions 12 the top side 30 of the panel 29 than on the top side 23 of the plate 22. The top side 30 of the panel 29 has a plurality of openings 14 extending therein. A pole 32 is attached to and extends downwardly from the bottom side 31 of the panel 29. The pole 32 has a free end defining a threaded male coupler.

A third candleholder 35 includes a display portion 36 and a support portion 37 that is attached to and extends downwardly from the display portion 36. The support portion 36 has a free end defining a threaded male coupler. The display portion 36 has an upper surface 38 having a convex shape. A plurality of aligned raised portions 12 is integrally attached to the upper surface 38 of the display portion 36. Each of the raised portions 12 attached to the display portion has a well 13 extending therein. The upper surface 38 has a plurality of openings 14 extending therein. The third candleholder 35 has a flower receiving eyelet 16 extending therein positioned generally at a juncture of the display portion 36 and the support portion 37. The male couplers 15 of the second 28 and third 35 candleholders are shown in an attached position and are the same type of male coupler 15 positioned on the rod 26.

A fourth candleholder 40 is provided that has a shape resembling a chalice. The fourth candleholder 40 has a highest central surface 41 that has a well 13 extending therein. Additionally, the fourth candleholder 40 may also include one or more openings 14 extending therein. The fourth candleholder 40 has a structure for standing alone without an attached base 50. The wells 13 of the candleholder preferably have tabs 17 mounted therein that are biased toward a central area of the wells 13 for aiding in the retention of varying sized candles 7. It is to be understood that the wells 13 are adapted for receiving candles 7 whiles the openings 14 are adapted for receiving flowers 8.

A fifth candleholder 42 may be provided that is elongated and includes a planar top 43 and bottom 44 surfaces. The top surface 43 has a plurality of wells 13 and openings 14 extending therein.

Each of a plurality of bases 50 has a bottom wall 51, a top wall 52 and peripheral wall 53 that extends between the top 52 and bottom 51 walls. Each of the top walls 52 has a threaded aperture 54 extending therein that defines a female coupler and is adapted for receiving a threaded male coupler 15. The bases 50 each preferably have a different size. Additionally, it is preferred that the bases 50 each have a frusto-pyramidal shape. An elastomeric coating 55 may be attached to the bottom wall 51 of the base 50.

A plurality of mounts 56 is provided for selectively receiving flower 8 stems. The mounts 56 are attached to the peripheral wall 53 of at least two of the plurality of bases 50. The mounts 56 preferably comprise a foamed polystyrene material such that the stems of the flowers 8, and more specifically artificial flowers, may be easily extended into the mounts 56.

Each of a plurality of extension members 60 is elongated and has an upper end 61 and a lower end 62. Each of the upper ends 61 defines a threaded female coupler 54 and each of the lower ends 62 defines a threaded male coupler 15. At least one of the extension members 60 has a plurality of holes 14 extending therein. The holes 14 are aligned between the upper 61 and lower 62 ends.

In use, the first 21, second 28 and third 35 candleholders are selectively coupled to the bases 50. This may be done directly or with the extension members 60 for raising the candleholders 20 above the bases 50. Candles 7 are selectively positioned in the wells 13 and flowers 8 may be extended into the various eyelets 16 and openings 14. The combinations that are possible allow for multiple uses for a plurality of functions such as weddings, anniversaries, birthdays and funerals.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A modular candleholder and ornamental set, said set including:

a first candleholder including an elongated plate having a top side having a plurality of wells extending therein, a rod being attached to a bottom side of said plate, said rod having a free end defining a threaded male coupler;

a second candleholder having a generally same shape of said first candleholder and a smaller size than said first candleholder, said second candleholder including an elongated panel having a top side having a plurality of wells extending therein, a pole being attached to and extending downwardly from a bottom side of said panel, said pole having a free end defining a threaded male coupler;

a plurality of bases, each of said bases having a bottom wall, a top wall and peripheral wall extending between said top and bottom walls, each of said top walls having a threaded aperture extending therein and being adapted for receiving a threaded male coupler, each of said bases having a different size;

a plurality of mounts for selectively receiving a flower stem, said mounts being attached to said peripheral wall of at least two of said plurality of bases; and wherein candles may be selectively positioned in said wells.

2. The modular candleholder and ornamental set of claim 1, wherein said plate and said panel each have a plurality of openings extending therein, said openings being positioned in a respective one of said top sides.

3. The modular candleholder and ornamental set of claim 1, further including a third candleholder including a display portion and a support portion being attached to and extending downwardly from said display portion, said support portion having a free end defining a threaded male coupler, said display portion having an upper surface having a convex shape, a plurality of aligned raised portions being integrally attached to said upper surface of said display portion, each of said raised portions having a well extending therein, said upper surface having a plurality of openings extending therein.

4. The modular candleholder and ornamental set of claim 3, wherein said third candleholder having a flower receiving eyelet extending therein positioned at a juncture of said display portion and said support portion.

5. The modular candleholder and ornamental set of claim 1, wherein each of said bases has a frusto-pyramidal shape.

6. The modular candleholder and ornamental set of claim 5, further including a plurality of mounts for selectively receiving a flower stem, said mounts being attached to said peripheral wall of at least two of said plurality of bases.

7. The modular candleholder and ornamental set of claim 6, wherein each of said mounts comprises a foamed polystyrene material.

8. The modular candleholder and ornamental set of claim 1, further including a plurality of extension members each being elongated and having an upper end and a lower end, each of said upper ends defining a threaded female coupler and each of said lower ends defining a threaded male coupler.

9. The modular candleholder and ornamental set of claim 8, wherein at least one of said extension members has a plurality of holes extending therein, said holes being aligned between said upper and lower ends.

10. The modular candleholder and ornamental set of claim 3, further including a fourth candleholder having a shape resembling a chalice, said fourth candleholder having a highest central surface having a well extending therein.

11. The modular candleholder and ornamental set of claim 10, further including a plurality of extension members each being elongated and having an upper end and a lower end, each of said upper ends defining a threaded female coupler and each of said lower ends defining a threaded male coupler.

12. The modular candleholder and ornamental set of claim 11, wherein at least one of said extension members has a plurality of holes extending therein, said holes being aligned between said upper and lower ends.

13. A modular candleholder and ornamental set, said set including:

a first candleholder including;

an elongated plate having a top side and a bottom side, a plurality of aligned raised portions being integrally attached to said top side, each of said raised portions having a well extending therein, said top side having a plurality of openings extending therein;

a rod being attached to and extending downwardly from said bottom side, said rod having a free end defining a threaded male coupler, said rod having a flower receiving eyelet extending therein;

a second candleholder having a generally same shape of said first candleholder and a smaller size than said first candleholder, said second candleholder including;

an elongated panel having a top side and a bottom side, a plurality of aligned raised portions being integrally attached to said top side of said panel, each of said raised portions attached to said panel having a well extending therein, said top side of said panel having a plurality of openings extending therein;

a pole being attached to and extending downwardly from said bottom side of said panel, said pole having a free end defining a threaded male coupler;

a third candleholder including a display portion and a support portion being attached to and extending downwardly from said display portion, said support portion having a free end defining a threaded male coupler, said display portion having an upper surface having a convex shape, a plurality of aligned raised portions being integrally attached to said upper surface of said display portion, each of said raised portions attached to said display portion having a well extending therein, said upper surface having a plurality of openings extending therein, said third candleholder having a flower receiving eyelet extending therein positioned at a juncture of said display portion and said support portion;

a plurality of bases, each of said bases having a bottom wall, a top wall and peripheral wall extending between said top and bottom walls, each of said top walls having a threaded aperture extending therein and being adapted for receiving a threaded male coupler, each of said bases having a different size;

a plurality of mounts for selectively receiving a flower stem, said mounts being attached to said peripheral wall of at least two of said plurality of bases, each of said mounts comprising a foamed polystyrene material;

a plurality of extension members each being elongated and having an upper end and a lower end, each of said upper ends, defining a threaded female coupler and each of said lower ends defining a threaded male coupler, at least one of said extension members having a plurality of holes extending therein, said holes being aligned between said upper and lower ends;

a fourth candleholder having a shape resembling a chalice, said fourth candleholder having a highest central surface having a well extending therein; and wherein candies may bc selectively positioned in said wells.

14. A modular candleholder and ornamental set, said set including:

a first candleholder including an elongated plate having a top side having a plurality of wells extending therein, a rod being attached to a bottom side of said plate, said rod having a free end defining a threaded male coupler;

a second candleholder having a generally same shape or said first candleholder and a smaller size than said first candleholder, said second candleholder including an elongated panel having a top side having a plurality of wells extending therein, a pole being attached to and extending downwardly from a bottom side of said panel, said pole having a free end defining a threaded male coupler;

a third candleholder including a display portion and a support portion being attached to and extending downwardly from said display portion, said support portion having a free end defining a threaded male coupler, said display portion having an upper surface having a convex shape, a plurality of aligned raised portions being integrally attached to said upper surface of said display portion, each of said raised portions having a well extending therein, said upper surface having a plurality of openings extending therein;

a plurality of bases, each of said bases having a bottom wall, a top wall and peripheral wall extending between said top and bottom walls, each of said top walls having a threaded aperture extending therein and being adapted for receiving a threaded male coupler, each of said bases having a different size; and wherein candles may be selectively positioned in said wells.

* * * * *